US011802746B2

(12) United States Patent
Palovaara

(10) Patent No.: US 11,802,746 B2
(45) Date of Patent: Oct. 31, 2023

(54) SAFETY DEVICE ARRANGEMENT FOR FIREARM WITH MAGAZINE WELL

(71) Applicant: Ilpo Palovaara, Oulu (FI)

(72) Inventor: Ilpo Palovaara, Oulu (FI)

( * ) Notice: Subject to any disclaimer, the term of this patent is extended or adjusted under 35 U.S.C. 154(b) by 0 days.

(21) Appl. No.: 17/625,160

(22) PCT Filed: Jul. 7, 2020

(86) PCT No.: PCT/FI2020/000013
§ 371 (c)(1),
(2) Date: Jan. 6, 2022

(87) PCT Pub. No.: WO2021/005262
PCT Pub. Date: Jan. 14, 2021

(65) Prior Publication Data

US 2022/0268544 A1 Aug. 25, 2022

(30) Foreign Application Priority Data

Jul. 8, 2019 (FI) ..... 20197102

(51) Int. Cl.
*F41A 17/44* (2006.01)
*A47B 81/00* (2006.01)
(Continued)

(52) U.S. Cl.
CPC ..... *F41A 17/44* (2013.01); *A47B 81/005* (2013.01); *F41A 23/005* (2013.01); *F41A 23/18* (2013.01)

(58) Field of Classification Search
CPC ..... F41A 17/44; F41A 23/00; F41A 17/00; F41A 17/02; F41A 17/04; F41A 23/16; A47B 81/005
See application file for complete search history.

(56) References Cited

U.S. PATENT DOCUMENTS 3,089,272 A * 5/1963 McKinlay ..... F41A 17/44 42/70.11
4,384,420 A * 5/1983 Von Muller ..... F41A 17/44 42/70.11
(Continued)

FOREIGN PATENT DOCUMENTS

GB 2 123 683 2/1984

OTHER PUBLICATIONS https://www.thefirearmblog.com/blog/2015/03/03/arma-15-wall-mount/; Nicholas; Arma 15 Wall Mount; Mar. 3, 2015 (Year: 2015).*
(Continued)

*Primary Examiner* — Joshua E Freeman
(74) *Attorney, Agent, or Firm* — Nixon & Vanderhye PC

(57) ABSTRACT

A safety device arrangement for a firearm with a magazine well comprising an insert (3A) adapted to the dimensions and shape of the magazine well and being lockable therein and a rack element (4A) for carrying the firearm, the body of the insert (5A) exposed from the magazine well being adapted in dimensions and shape to fit against the carrier part (17) of the rack element, is characterised in that the carrier part of the rack element is provided with an opening, slot or equivalent (18) and the body of the insert exposed from the magazine well provided with a hollow protrusion (7) adapted to fit to said opening, slot or equivalent and extended through and outside of the carrier part, and on the other hand opening inside the body, and that in the locking mechanism between the insert and the magazine well essential bar or equivalent (9) with its accessories (10, 11, 12) extending inside the insert is implemented to depart from and being lockable in said protrusion. In a preferred embodiment the base part (10) of said bar or equivalent (9) is fitted to pivot in the protrusion (7) and rotate the bar with its accessories between a position locking the insert to the
(Continued)

magazine well, and a position releasing the locking, the protrusion and the base part comprising an arrangement (8, 14) for securing the locking position with a lock (22, 23).

18 Claims, 9 Drawing Sheets

(51) Int. Cl.
*F41A 23/00* (2006.01)
*F41A 23/18* (2006.01)

(56) References Cited

U.S. PATENT DOCUMENTS 4,528,765 A * 7/1985 Johnson ..... F41A 17/44 42/70.11
4,532,729 A * 8/1985 Von Muller ..... F41A 17/02 42/70.11
4,619,062 A * 10/1986 Johnson ..... F41A 17/44 42/70.11
4,654,992 A * 4/1987 Lavergne ..... F41A 17/02 42/70.11
4,709,496 A * 12/1987 Johnson ..... F41A 17/44 42/70.11
5,548,915 A 8/1996 Szarmach et al.
6,052,934 A * 4/2000 Carpenter ..... F41A 17/44 42/70.11
6,256,919 B1 * 7/2001 Brazeau ..... F41A 17/44 42/70.11
6,256,920 B1 * 7/2001 Olson ..... F41A 17/44 42/70.11
6,804,906 B1 * 10/2004 Olsen ..... F41A 17/44 42/70.11
7,543,403 B1 * 6/2009 Schaefer ..... F41A 17/02 42/70.11
8,931,201 B2 * 1/2015 Gianladis ..... F41A 23/18 42/94
D738,984 S * 9/2015 Mayberry ..... D22/108
9,677,835 B1 * 6/2017 Binns ..... F41A 17/54
10,203,176 B1 * 2/2019 Peterson ..... F41A 17/44
10,488,142 B2 * 11/2019 Jacobson ..... F41A 23/18
2002/0194763 A1 * 12/2002 Olsen ..... F41A 17/44 42/70.11
2008/0120888 A1 * 5/2008 Matyko ..... F41A 17/44 42/70.11
2015/0290775 A1 * 10/2015 Bennett ..... B25B 11/00 269/287
2017/0241730 A1 * 8/2017 Ochoa ..... F41A 17/44
2018/0238650 A1 * 8/2018 Stockton ..... F41A 17/44

OTHER PUBLICATIONS

Extended European Search Report dated Jul. 15, 2022 in corresponding European Application No. 20837040.3, 8 pages.
International Search Report for PCT/FI2020/000013, dated Nov. 4, 2020, 3 pages.
Written Opinion of the ISA for PCT/FI2020/000013, dated Nov. 4, 2020, 6 pages.
FI Search Report 20197102, dated Jan. 16, 2020, 1 page.
FI Search Report for 20207118, dated Jan. 29, 2021, 2 pages.

* cited by examiner

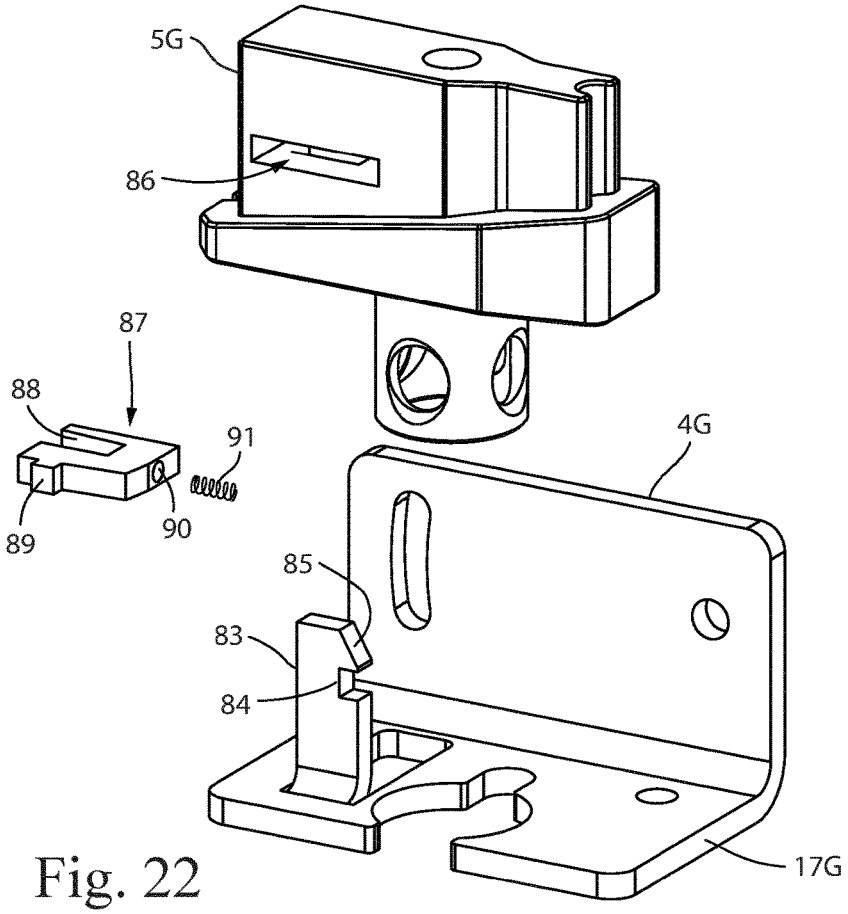
Fig. 22
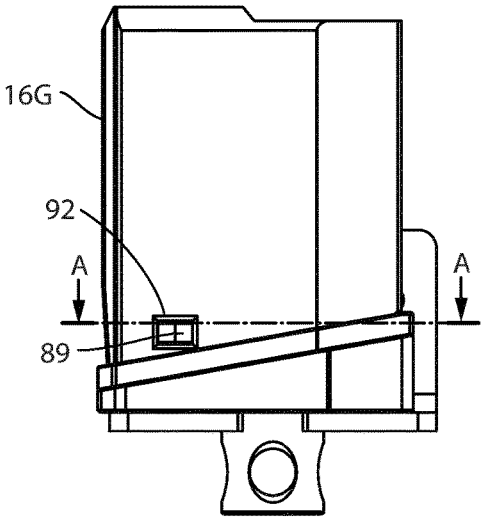
Fig. 23
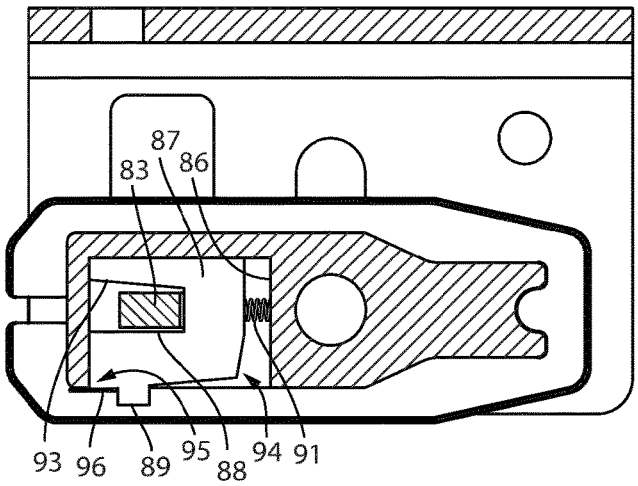
Fig. 24
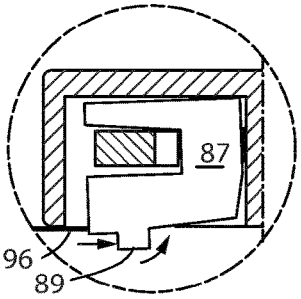

SAFETY DEVICE ARRANGEMENT FOR FIREARM WITH MAGAZINE WELL

This application is the U.S. national phase of International Application No. PCT/FI2020/000013 filed 7 Jul. 2020, which designated the U.S. and claims priority to FI Patent Application No. 20197102 filed 8 Jul. 2019, the entire contents of each of which are hereby incorporated by reference.

FIELD OF THE INVENTION

The invention is related to a safety device arrangement for firearms with a magazine well, and is intended to be used in storage, transport and demonstration of such firearms. This kind of firearms are, for example, many rifle-type arms today.

BACKGROUND OF THE INVENTION

Safety device arrangements in which the use of a firearm is prevented by placing and locking in the magazine well an insert adapted to its dimensions and shape and provided with a locking arrangement and a lock are as such known.

The publication EP 2365272 B1 presents one such solution for rifle-type arms. It includes also other features than the closing of the magazine well, but the effects and benefits of the solution are limited to preventing the use of the firearm. As an alternative locking embodiment a rotating locking bar or equivalent operating inside the insert is presented.

The solution of U.S. Ser. No. 10/203,176 B1 is a support leg the bottom end of which is securable to a suitable mounting surface and the top end of which is adaptable and may be locked to a magazine well of a firearm. For a certain firearm there is at a certain place a support leg on which the firearm may by means of the magazine well be positioned and locked if desired. The locking arrangements inside the insert may include a bar working as a lever or sliding and having a wedge end for forcing a pin or equivalent to locking position.

The publication US 2018238650 A1 presents a rack element to which is by means of a hinge connected a lock latch provided with a hole, the latch being reversible through a slot inside the magazine well and the top end of an insert. The top end of a pin or equivalent brought under the rack element through the insert extends to attach to the hole of the latch, and the bottom end of the pin is provided with a tab with a hole by means of which the pin may be locked by means of a padlock, for example, to an analogous tab extending downwards from the rack element.

A purpose of the invention is to present a remarkably more versatile safety device arrangement for storage, transport and demonstration of firearms. Another object is a solution the realisation of which is possible to standardize so that same elements may be used in safety devices for different types of firearms and different firearm brands.

SUMMARY OF THE INVENTION

To accomplish the above objects and purposes, a safety device arrangement for a firearm with a magazine well according to the invention comprising an insert which is adapted to the dimensions and shape of the magazine well and is lockable therein and a rack element for carrying the firearm, whereupon the body of the insert exposed from the magazine well is adapted in dimensions and shape to fit against the carrier part of the rack element, is characterised in that which is defined in the characterising part of the independent claim 1 of the appended claims. Other claims define various embodiments of the invention.

The solution according to the invention may be used as a gunlock, only, for example to close and lock the magazine well of a firearm for transport.

The locked firearm may be placed loosely on a rack. As the carrying rack element is adapted to the dimensions and shape of the protruding part of the insert, the firearm is also without locking there well supported and stable.

The insert may also be locked to the carrying rack element so that the same lock is locking the insert to the magazine well and protects locking between the insert and the rack element. The locking of the insert to the rack element may be automatically operating or selectable to operate as such, and may also then be opened manually when the locking between the insert and the firearm is opened and the insert is available.

The solution also enables the arrangement in which a tether wire which is securely attached at both ends connects the insert locked to the magazine well but not to the rack element and the rack element. In this way, for example, demonstration of the firearm can be done securely and in a controlled manner.

The dimensions and shape of the protruding part of the insert and respectively the rack element may be identical for a very wide range of different firearms. The same racks are thus well suited for efficient and secure storing of different firearms.

The solution may be realised also so that there is an adaptation part conforming to the dimensions and shape of the magazine well and having a space shaped in a certain way for a special locking body. Then also the locking body may be largely similar for several firearm types and brands, which improves the usability of the solution and makes it even more cost effective. It is also possible to make a magazine so that it may be converted with certain accessories to an insert of a safety device arrangement and then reconstituted by removing the accessories.

An advantage of the invention is also that the lock used in the arrangement may be an ordinary lock used in many other applications, for example a suitable padlock.

BRIEF DESCRIPTION OF THE DRAWINGS

The invention and some embodiments thereof are described in more detail below with reference to the accompanying drawings, in which:

FIGS. 22 to 24 present a possible realisation of the locking between the insert and the rack element.

DETAILED DESCRIPTION OF THE INVENTION

Figure 1:
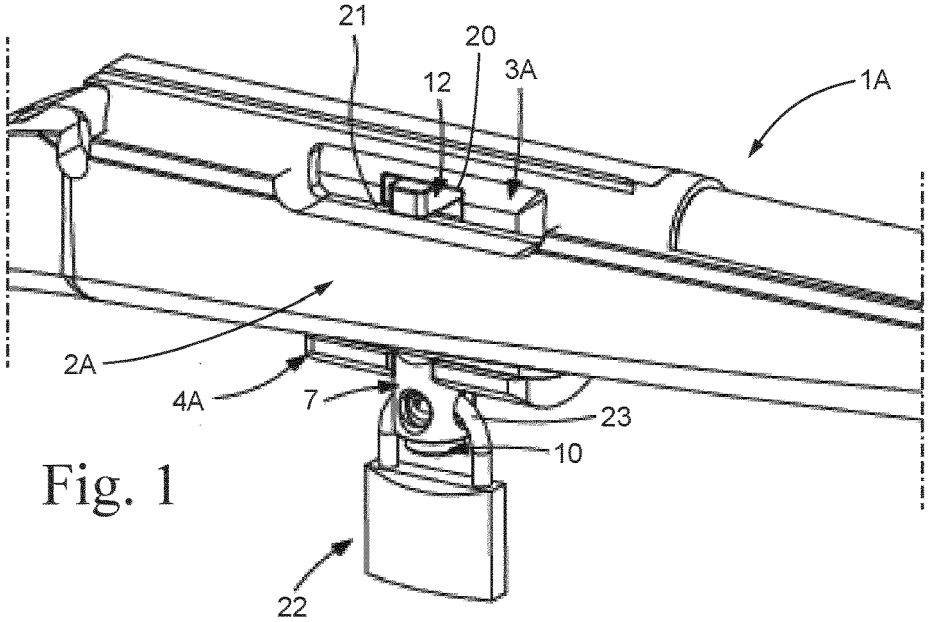
FIGS. 1 to 3 describe essential features of an embodiment of the invention.

FIG. 1 presents the central portion of a rifle gun 1A and there the magazine well (at the location inside the gun indicated by the arrow 2A) into which the magazine loaded with bullets is placed when tha gun is used. When the gun is not used, the magazine well can be utilised in the safety arrangements for preventing the gun from being used and locking it to a storage or transport cradle.

Figure 2:
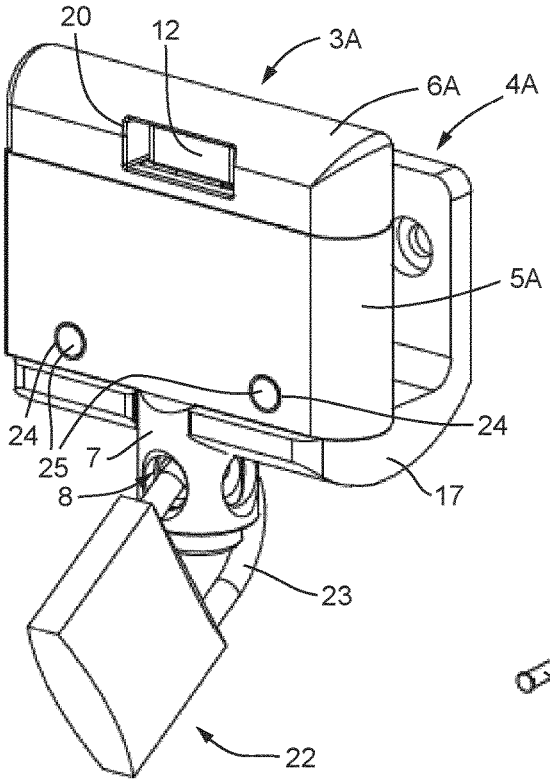
Figure 3:
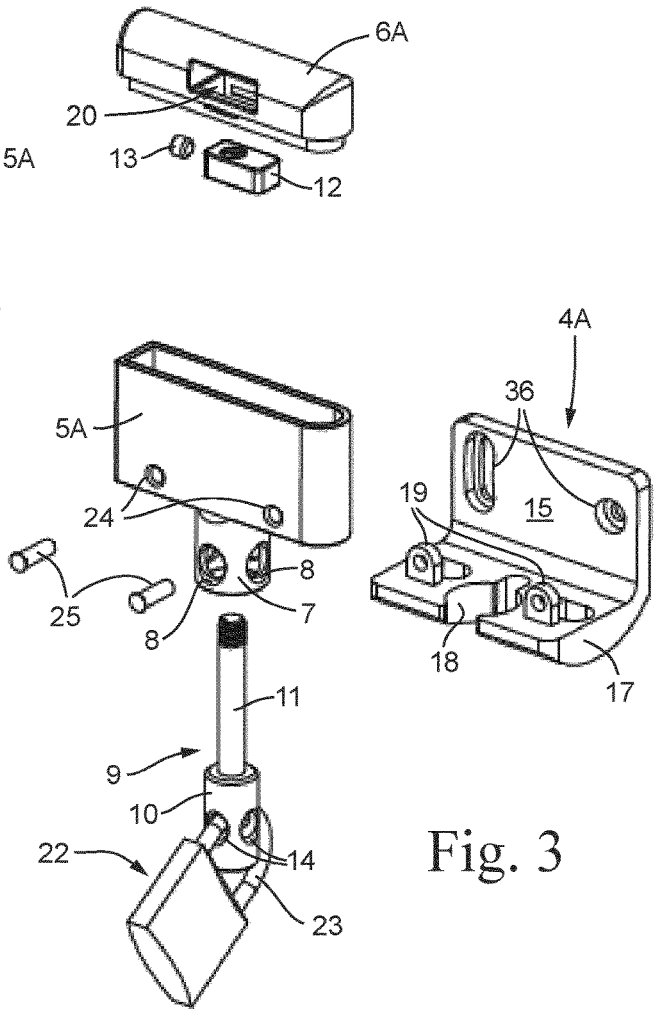

In the safety device arrangement of FIGS. 1 to 3 to the magazine well 2A is set an insert 3A the dimensions and shape of which have been adapted to fit thereto, the insert comprising a body 5A, a top part 6A and a locking mechanism operating within the body. The locking mechanism is considered below.

At the bottom of the body there is a hollow cylindrical protrusion 7 the walls of which are provided with holes 8 for e.g. locking by means of a padlock in the way described below. An essential part in the locking mechanism between the insert and the magazine well and by way of it the firearm is a rotating locking bar 9, the base part 10 of which is adapted to fit in the hollow protrusion 7 and is provided with holes 14 which in size and shape are analogous to the holes 8. The locking bar extends forward from the base part 10 as a thinner rod 11 to the end of which a locking latch 12 is attached and secured with a screw 13. When the locking bar 9 assembled in this way is in place in the insert 3A, the latch 12 is targeted at the opening 20 in the top part 6A. The opening 20 is dimensioned and positioned so that, when the insert 3A is set in the magazine well, it is targeted at the opening 21 in the side wall of the magazine well. The locking bar 9 is rotated by means of the base part 10 suitably exposed from the protrusion 7, and when it is rotated (FIG. 1) so that the latch 12 is turned to extend through the opening 20 and also the opening 21 of the magazine well where it is set against its lower edge, the insert 3A is firmly attached to the firearm and closes the magazine well 2A. In this position a padlock 22, the shackle 23 of which goes through the targeted holes 8 and 14, ensures the locking.

A rack element 4A, which is essential in the safety device arrangement, includes part 17 for carrying a firearm and side plate part 15 and there holes 36 for attaching the element with screws or the like in a suitable position to a carrier frame or other platform. When the firearm 1A is placed and locked in the rack, as in FIG. 1, it covers the screws and prevents loosening the rack element and firearm from the platform. The carrier part 17 is provided with a slot 18 which is to some extent open at the side of the carrier part and is dimensioned to receive the cylindrical protrusion 7 of the insert 3A. The protrusion may be extracted from the slot only upwards, not to lateral directions.

The carrier part is provided also with plate-shaped projections 19 with holes, the projections being adapted to be set inside the insert body 5A so that said holes are aligned with the corresponding holes 24 in the side walls of said insert body. So the insert 34 may by means of the pins 25 be fastened to the carrier part 17, if desired. When the firearm is then locked to the insert, it is locked also to the rack and at the same time covers said pins. The lockings may be released only by releasing first the firearm from the locking to the insert and then the fastening of the insert to the rack.

In FIG. 1 the shackle 23 of the padlock 22 is led through the corresponding holes 8 and 14 of the protrusion 7 and the base part 10 of the locking bar in the direction of the firearm. Although the insert 3A were now not fastened with pins or equivalent to the rack element 4A, the firearm 1A cannot be released therefrom because the shackle 23 of the lock in this position prevents the insert and the firearm locked thereto from being lifted off the rack.

Figure 4:
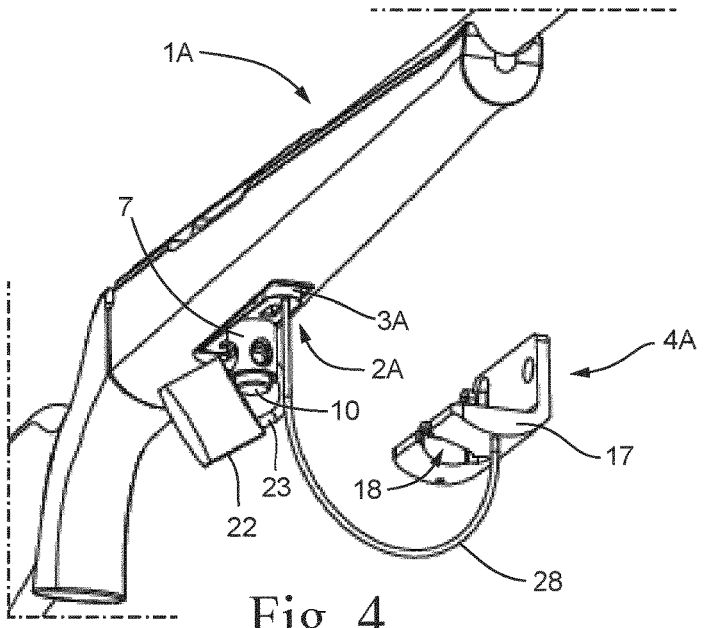
FIG. 4 presents generally a solution according to FIGS. 1 to 3, the solution comprising also a tether wire connecting together the insert and the rack element.

In FIG. 4 the shackle 23 of the padlock 22 is led through the corresponding holes 8 and 14 of the protrusion 7 and the base part 10 of the locking bar in the direction traverse to the firearm. When the insert 3A is not fastened to the carrier part by pins or other means the firearm may be elevated upwards, and the shackle 23 and also the body of the padlock 22 can be elevated with the firearm through the open side of the slot 18. The arrangement includes now also a tether wire 28 connecting to each other the insert 3A and the rack element 4A. The attachments of the wire ends to the insert and the rack element can be, for example, as shown in FIGS. 5 and 6.

In the solution according to FIGS. 1 to 3, the dimensioning, shaping and, to some extent, the operation of the insert and the parts operating in it must be designed and implemented in accordance with the dimensions, shaping and operation of the magazine well and parts operating in connection with it of the firearm concerned.

Figure 5:
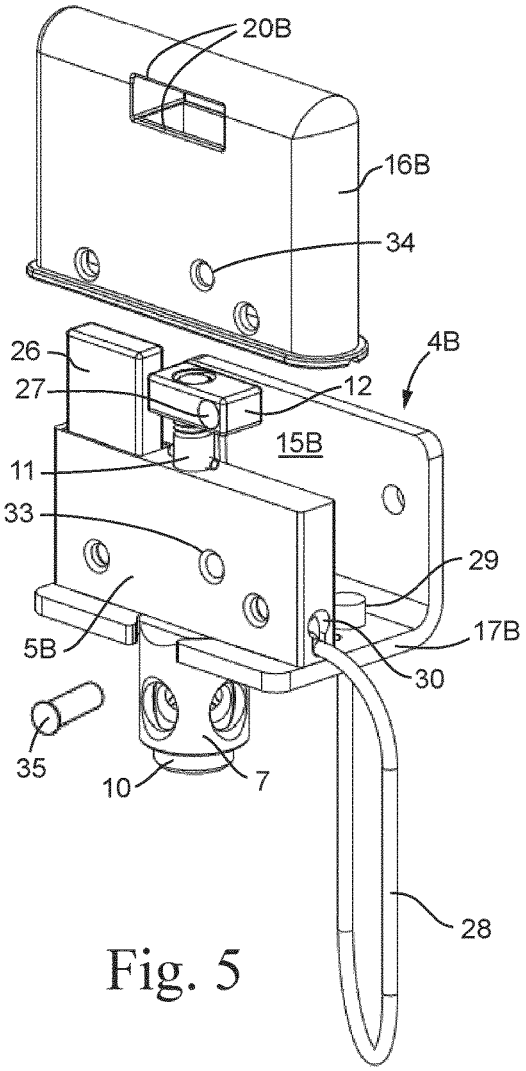
FIGS. 5 and 6 present an example of an embodiment in which the insert is formed by a general-purpose locking body and an adapter part compatible with the magazine well of a firearm concerned, the embodiment comprising also a tether wire.
Figure 6:
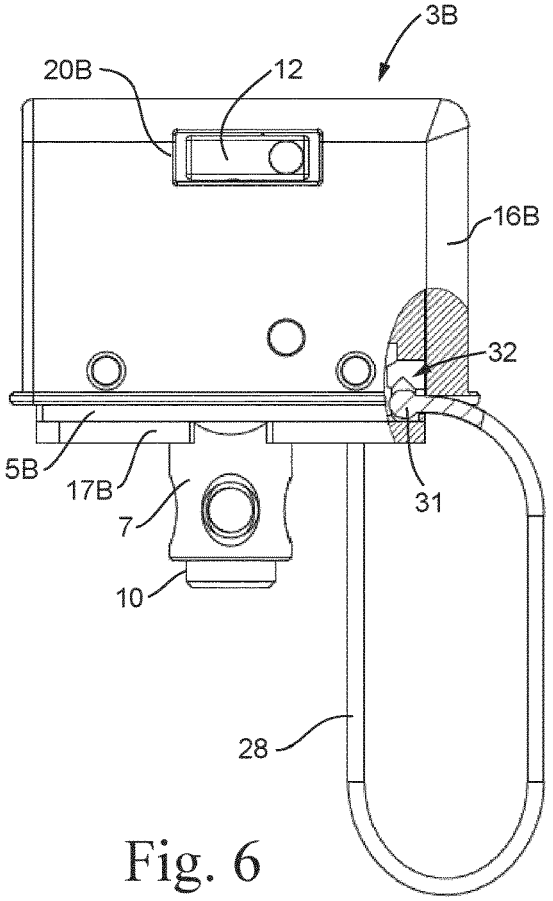

FIGS. 5 and 6 present an example in which the actual operating part of the insert, i.e. the locking body 5B with its accessories, is meant for general use. The locking body is covered by a shell or like 16B placed on it and fitting it to the magazine well. The body and the shell are fastened to each other e.g. by means of a locking pin 35 for which they comprise corresponding holes 33 and 34. The fastening may be made also by means of a suitable screw. For the operation of the locking latch 12 the fitting shell 16B is provided with an opening 20B. The rack element 4B is essentially similar to that in FIGS. 1 to 3 including the carrier part 17B and the side plate part 15B.

The safety device arrangement may also be provided with various accessories. For example, there may be a wireless alarm device 26 for operation of which a magnetic chip 27 is attached to the latch (FIG. 5). When the latch is closed the chip is moved close to the alarm device which is then activated. If the latch is then forced to open or opened without permission, an alarm is result.

For mounting the tether wire 28, the carrier part 17B of the rack element has a suitable hole through which the end to be connected to the insert 3B can be threaded through until the base, knob or equivalent 29 at the other end comes against the carrier part to hold the wire therein. At the other end of the wire there is a smaller knob 31 which can be inserted through the downwardly shrinking opening 30 at the end of the locking body 5B, and after attaching the fitting shell 16B, its edge and the protrusion 32 therein will press the end of the wire and hold it in place.

Figure 7:
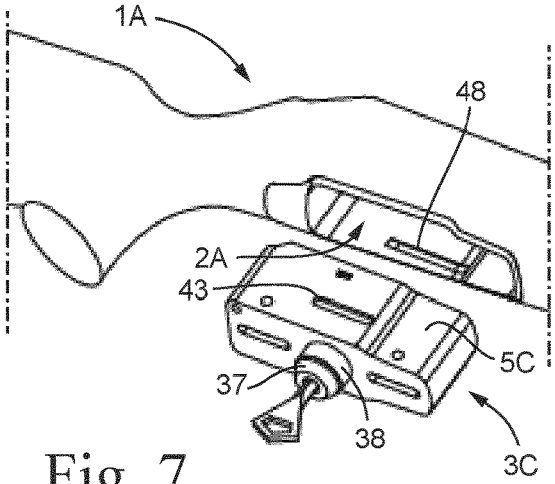
FIGS. 7 to 9 describe another example of the solution according to the invention applied to a rifle gun.
Figure 8A:
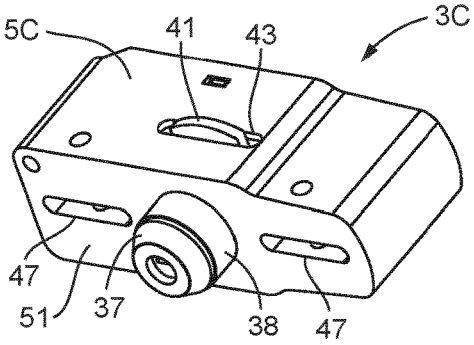
Figure 8B:
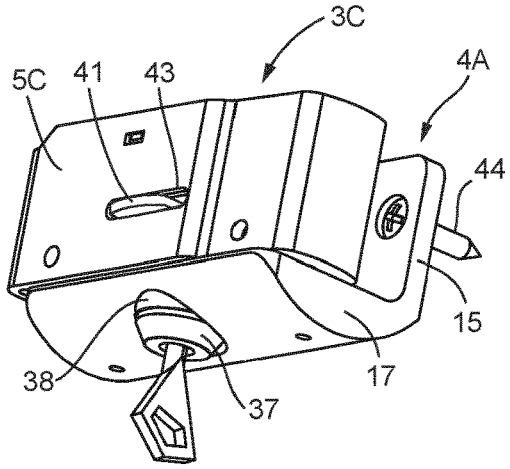
Figure 9:
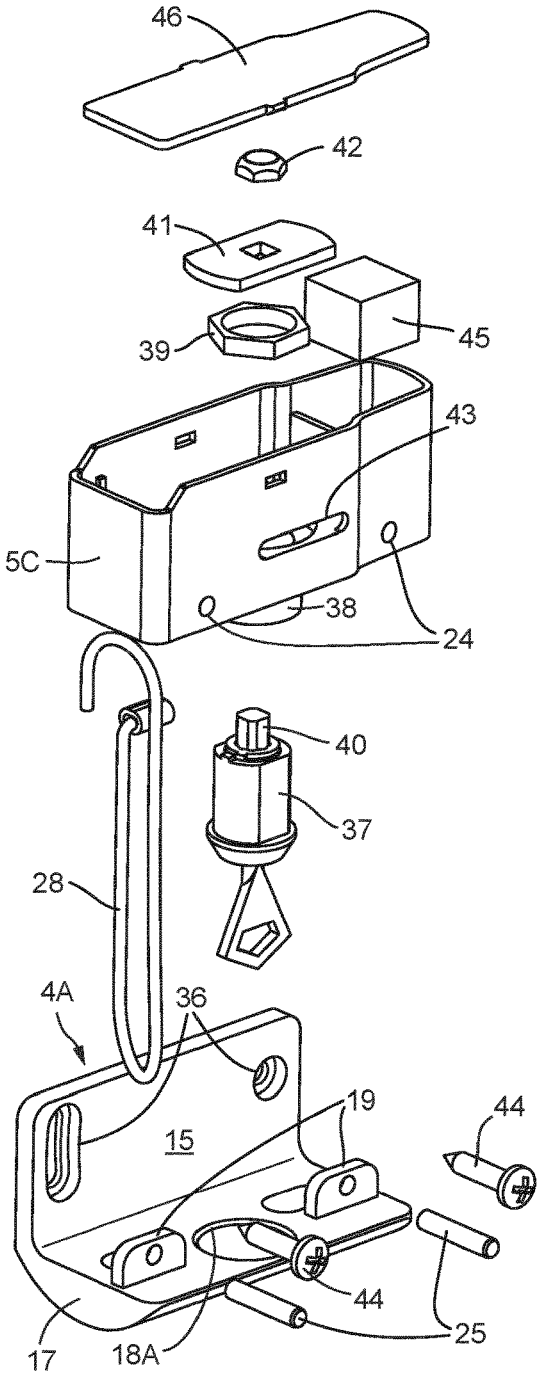

The example shown in FIGS. 7 to 9 is largely similar to that shown in FIGS. 1 to 3, but differs to some extent in the implementation of the locking mechanisms and means. FIG. 7 shows the center of the rifle gun 1A and there the magazine well 2A and the insert 3C provided with the lock to be fitted in the magazine well, seen obliquely from below. FIG. 8(*a*) shows the insert 3C obliquely from below in a closer view, and FIG. 8 (*b*) shows it placed on the rack element 4A. FIG. 9 is an exploded view of this assembly.

The locking mechanism implemented in connection with the insert 3C is as follows. The insert comprises the locking body 5C, the cylindrical protrusion 38 at the bottom 51 of which is fitted to the dimensions of the circular opening 18A of the carrier part 17 of the rack element 4A. The cylindrical lock 37 fitted to the inner dimensions of the protrusion 38 is threaded and secured in place by a threaded ring 39 which is tightened from the inside against the bottom 51 of the locking body 5C. A latch 41 is secured to the top end of the locking shaft 40 by means of a threaded ring 42.

In this case, the side walls of the magazine well 2A of the rifle gun 1A are provided with grooves 48 for locking the magazine in place. On the other hand, the side walls of the locking body 5C of the insert are provided with slots 43 being parallel to and targeted at the grooves 48, wherein the latch 41 is turned through the slots to reach the grooves 48 and secure locking.

In this case, the lock or parts of the lock cannot fasten the insert 3C to the rack element 4A. This is done by placing the insert 3C in place on the rack element 4A, whereby its exposed part, the base 51 with the protrusion 38 and openings 47, comes against the carrier part 17 of the rack element. The projections 19 of the carrier part enter through the openings 47 into the locking body 5C and are targeted at the openings 24 in its side wall (FIG. 9). The locking takes place by means of pins 25 which are inserted through the openings into the holes of the projections 19. When the rifle gun is now placed on the rack the insert supporting it there, and then the gun is locked to the insert, the openings of the pins and also the fixing screws 44 of the rack element are covered at the same time, whereby it is not possible to remove the gun from the rack without braking it.

If it is not desired to lock the insert 3C locked to the gun 1A to the rack element 4A, then it is also in this case possible to use a tether wire 28 fastened at one end to the insert and at the other end to the rack element to ensure that the gun is kept close to the rack although it is possible, for example, to take it from the rack for demonstration and inspection. A possible fastening method was described above with reference to FIGS. 5 and 6.

Inside the locking body there is also space for a lock alarm device 45. The insert is protected from the top by a cover plate 46.

Figure 10:
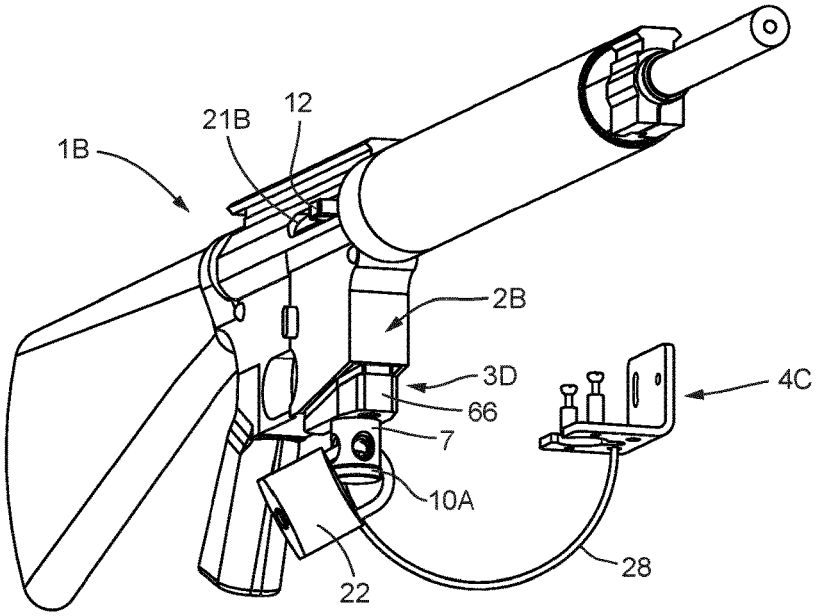
FIGS. 10 to 12 describe a further embodiment of the safety device arrangement according to the invention.
Figure 12:
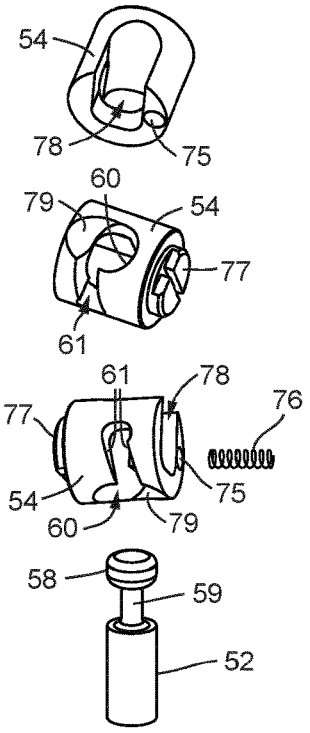
Figure 11:
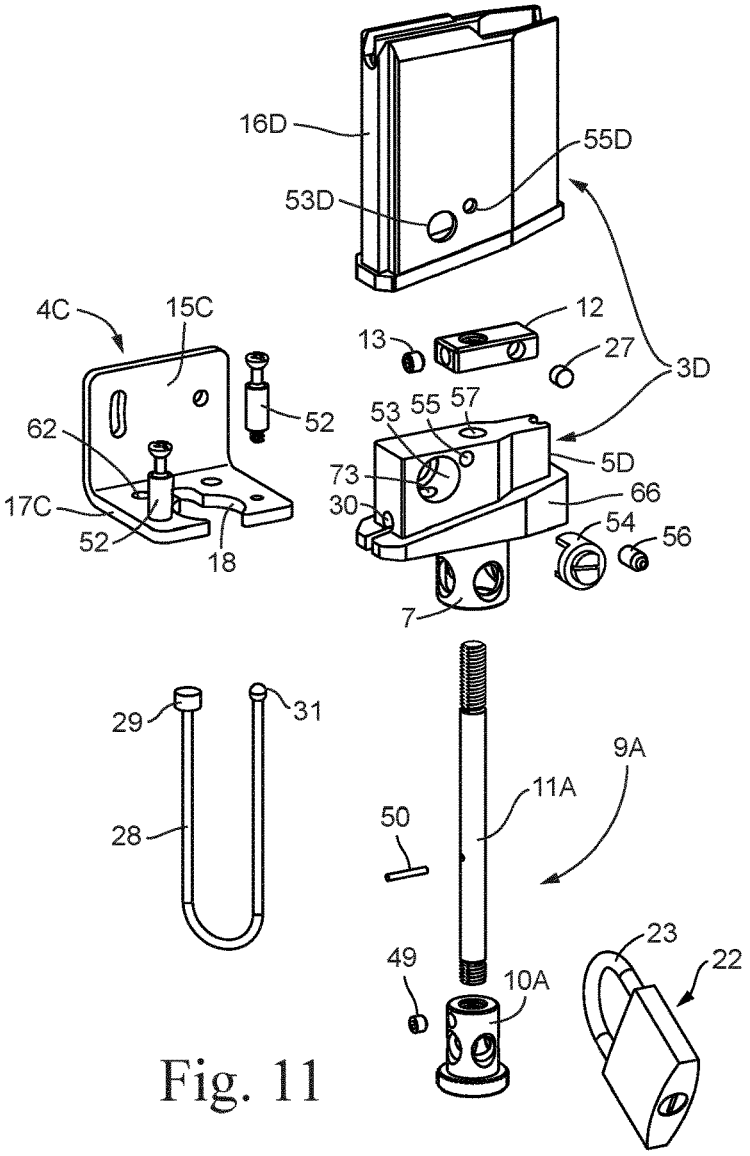

In the safety device arrangement of a handle rifle 1B shown in FIGS. 10 to 12, the insert 3D is formed by a locking body 5D and parts operating in it and a fitting part 16D made from the magazine shell of this firearm by providing it by holes 53D and 55D needed in this use. The hole 53D and a corresponding opening and space 53 in the locking body are adapted for a pivot bushing 54, by means of which the insert is locked to the rack element 4C. The hole 55D and the corresponding opening 55 in the body 5D are fitted for a pin 56 or the like, by means of which the locking body and the fitting part are locked to each other.

The lower part 66 of the locking body is the part of the insert 3D protruding from the magazine well, and the base of it is adapted to fit against the carrier part 17C of the rack element 4C.

The base part 10A of the locking bar is fixed to the lower end of the rod 11A by screwing, and the fastening is secured with a screw 49. A pin 50 passing through the rod 11A ensures that the locking bar passing through the hole 57 in the locking body remains in its position in the body. The latch 12 is attached by screwing to the upper end of the rod 11A, and the attachment is secured with a screw 13. The latch has space for a magnetic chip 27 required for alarm operation to be placed therein.

The locking bar extends through the insert above the fitting part 16D. The side wall of the magazine well 2B of the handle rifle 1B has an opening 21B to which the latch 12 is aligned and dimensioned to be turned in locking. The cylindrical protrusion 7 of the locking body, the base 10A of the locking arm and the lock 22 with the shackle 23 function as described in connection with FIGS. 1 to 3.

The rack element 4C is made of a suitable plate material. The side part 15C is as shown above, as well as the slot 18 open at the side of the carrier part 17C. For fastening the locking body 5D to the rack element 4C the carrier part is now provided with pegs 52 to which e.g. the pivot bushing 54 may be locked. FIG. 12 presents a closer look at an example of the pivot bushing 54 and the locking peg 52. When the insert is placed on the carrier part, the base against it, to which the peg 52 is attached, the pivot bushing 54 is in the position above the peg, in which it is in FIG. 12. The bushing is pushed into the space 53 from which its pivot base 77 remains visible, and at the other end the spring 76 placed in the recess 75 remains partially exposed and is pressed against the bottom of the space 53 for the bushing. The knob 58 of the peg goes through the opening 60 of the bushing to its hollow interior. The bushing has an oblique surface 79 which, together with the spring 76, allows the bushing to move against the spring force, and when the peg knob 58 is in the opening 60 of the bushing, the peg is locked against the edge of the opening 78 by spring load automatically. In this situation, the locked firearm can be placed on the rack so that it can be obtained from the rack only by opening the lock. For additional security of the locking, from the opening 60 in the wall of the bushing extends a narrower slot 61, the width of which corresponds to the thickness of the neck 59 of the peg and which allows the bushing to be rotated, whereby the end 58 of the peg becomes locked inside the bushing.

The connections of the tether wire 28 to the carrier part 17C and the insert 3D formed by the locking body 5D and the fitting part 16D, respectively, are as described in connection with FIGS. 5 and 6. The wire can be threaded the smaller knob 31 first through the hole 62 in the carrier part 17C, to which it is engaged by the larger base 29 at the other end. The knob 31 of the other end is inserted through the downwardly shrinking opening 30 at the lower edge of the body 5D, whereby fixing the fitting part 16D prevents the knob from getting out through the opening and ensures the fastening.

Figure 13A:
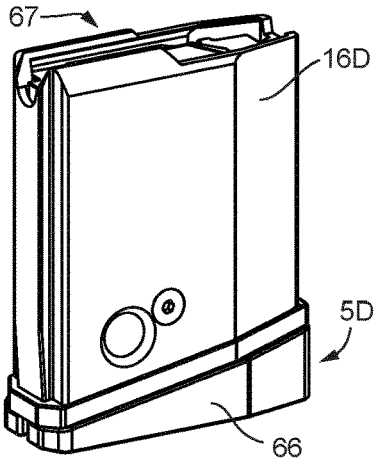
FIGS. 13 and 14 present an example wherein the realisation of a magazine and a safety device arrangement are joined so that the safety device arrangement is obtained by adding and connecting certain parts to the magazine.
Figure 13B:
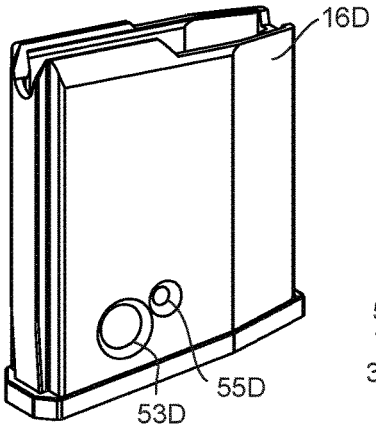
Figure 14A:
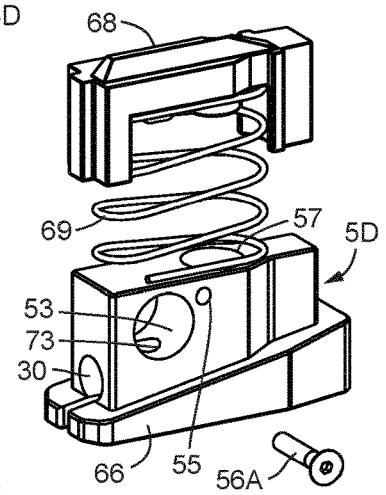
Figure 14A:
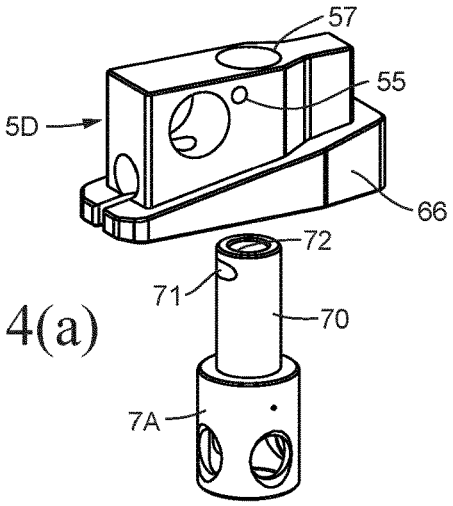
Figure 14B:
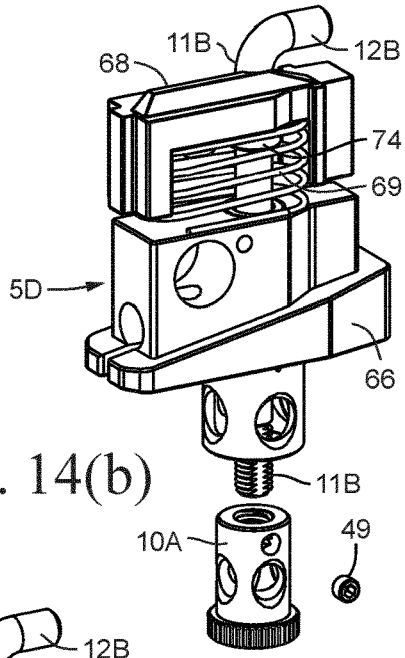
Figure 14C:
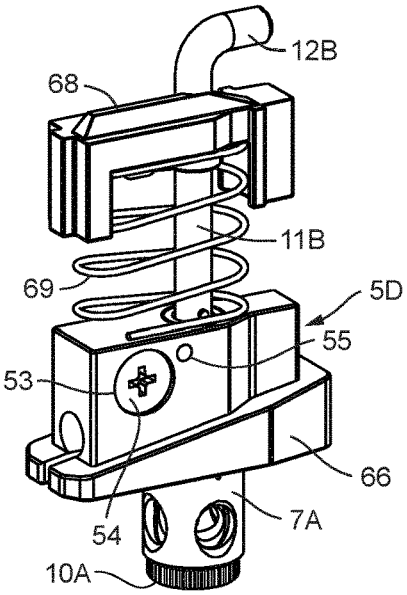
Figure 14D:
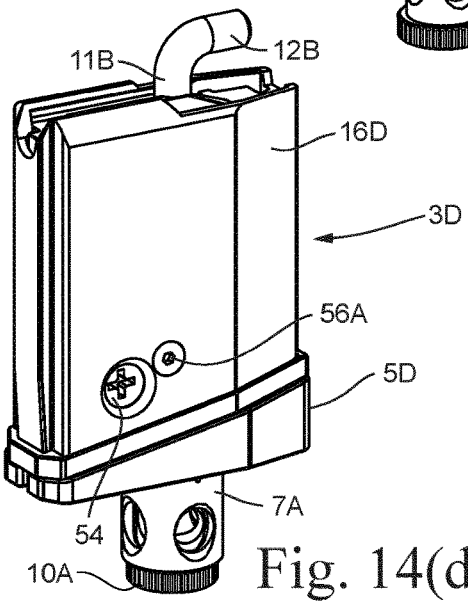

FIGS. 13 and 14 illustrate in more detail an example of combining an implementation of a magazine and a safety device arrangement so that by adding and combining certain parts to a magazine a safety device arrangement is obtained. FIG. 13(*a*) presents a magazine 67 thus realized, the parts of which are shown in FIG. 13(*b*). FIGS. 14(*a*) to 14(*d*) describe the fitting of the magazine and its conversion into the safety device arrangement.

The cartridge lifter 68 now acts by the force of the spring 69 on the magazine body 5D, which is realised as already shown in FIG. 11 above, so that it also acts as a locking body of the safety device arrangement. The magazine shell 16D is provided with holes or hole blanks 53D and 55D for locking functions, and its upper part is open so that the locking bar rod 11B can extend through it and the latch 12B operate above it. The shell 16D operates as a part of the insert 3D fitting to the magazine well, and the lower part of the body 5D is the part 66 protruding from the magazine well, the base of it being shaped and provided with necessary openings for setting and operating on the rack element (e.g. 4C in FIG. 11).

Extending vertically from the bottom of the body is a tubular passage 57 sized to fit the cylindrical extension 70 of the locking protrusion 7A needed in the body. The extension and with it the protrusion 7A is locked by means of the recess 71 and the pin 56A to the body, and at the same time also the fitting part 16D is locked to the body part through the respective holes 55D and 55. A channel 72 for the locking bar rod 11B passes through the extension 70.

Through the bottom of the locking body 5D, for example, the channel 73 for the locking peg 52 as shown in FIG. 11 enters the opening 53 in which operates the pivot bushing 54 locking the body to the carrier part of the rack element. At the lower edge of the locking body there is the opening 30 and a suitable hole for locking the end of a wire or the like to the body as described above in connection with FIGS. 5, 6 and 11.

FIG. 14 (*b*) illustrates the installation of the locking bar rod 11B. The cartridge lifter 68 has a channel 74 for this purpose, and through the extension 70 and the channel 72 the threaded lower end of the rod is brought into the projection 7A, and the base 10A of the locking bar can be screwed in place and the fastening be secured by a screw 49. The locking latch 12B is here accomplished by bending the top end of the rod suitably.

In FIG. 14(*c*) the locking body 5D with its parts is ready for operation, and in FIG. 14(*d*) also the fitting part 16D is locked in place and the insert 3D is completed.

Figure 15:
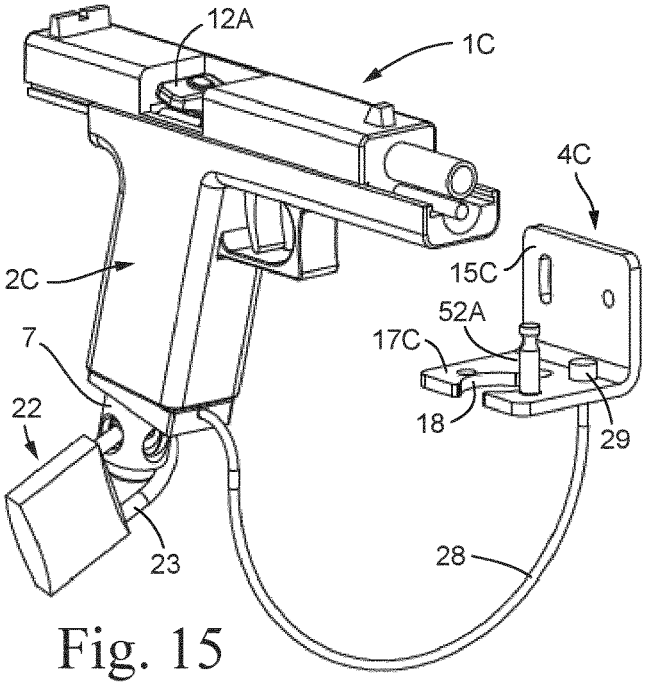
FIGS. 15 to 17 present an example of the safety device arrangement according to the invention applied to a pistol gun.
Figure 16:
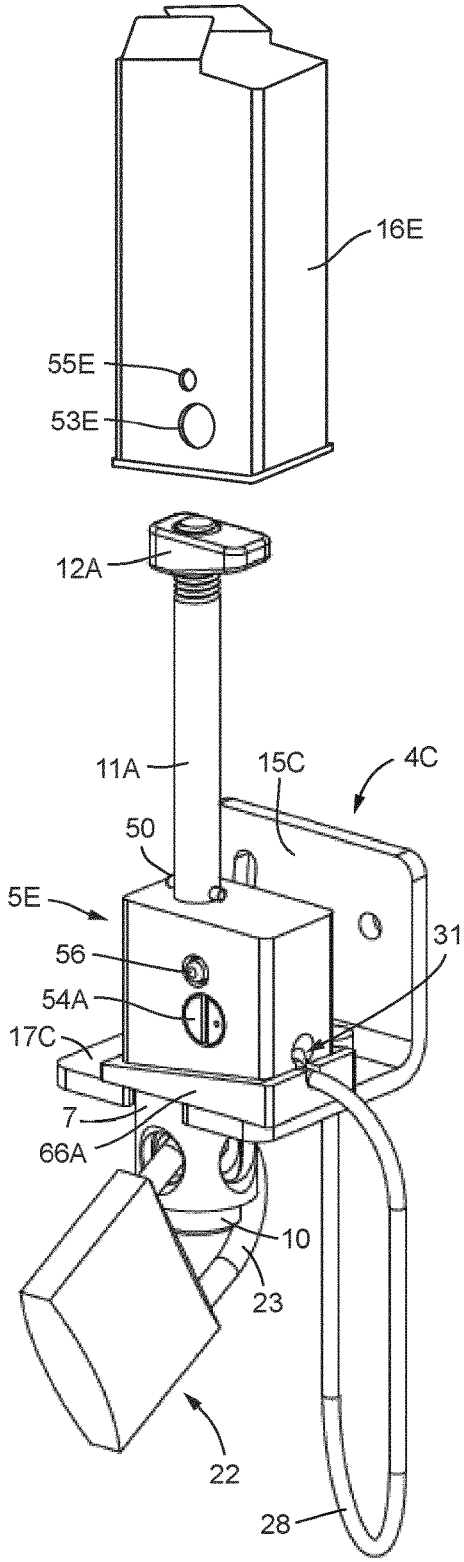
Figure 17:
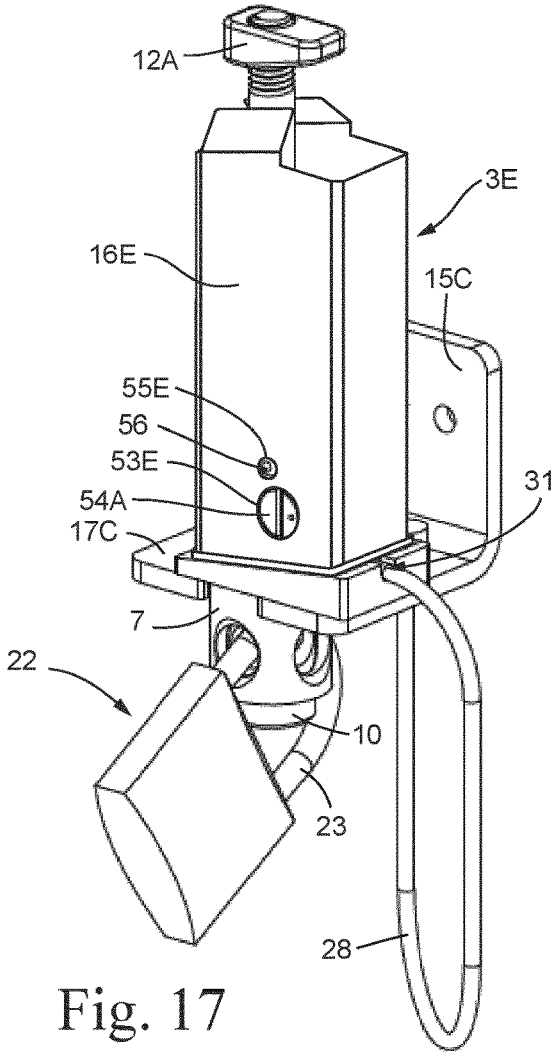

In the example of FIGS. 15 to 17, the safety device arrangement is applied to a pistol gun 1C and its magazine well 2C. The insert 3E is formed by a locking body 5E and its associated parts, as well as a fitting part 16E made of the magazine shell of this gun by providing it with holes 53E and 55E necessary for this use. Through the hole 53E, a pivot bushing 54A operating in the body is used to lock the insert to the peg 52A of the rack element 4C in the same manner as described above in connection with FIGS. 11 and 12. The hole 55E is for a pin or equivalent 56 with which the fitting part is locked to the locking body.

The base part 10 of the locking bar is fixed to the lower end of the rod 11A by screwing, and the pin 50 passing through the rod ensures that the locking bar remains inserted into the body. The latch 12A is screwed to the upper end of the rod 11A.

The locking bar extends through the insert above the fitting portion 16E, and the latch engages in rotation against the body structure of the gun. The cylindrical protrusion 7 of the locking body, the base part 10 of the locking arm and the lock 22 with the shackle 23 function as described in connection with FIGS. 1 to 3.

The rack element 4C is similar to that described above, and the same applies also to the connections of the tether wire 28 to the carrier part 17C of the rack element and the insert 3E formed by the locking body 5E and the fitting part 16E, respectively.

Figure 18:
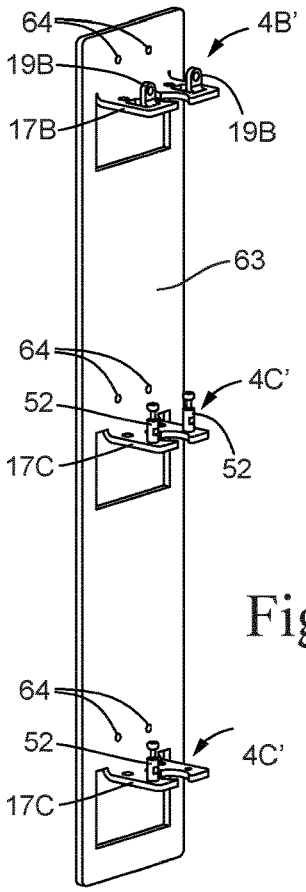
FIGS. 18 and 19 present an example of utilization of the solution according to the invention in storage and use of fire arms.
Figure 19:
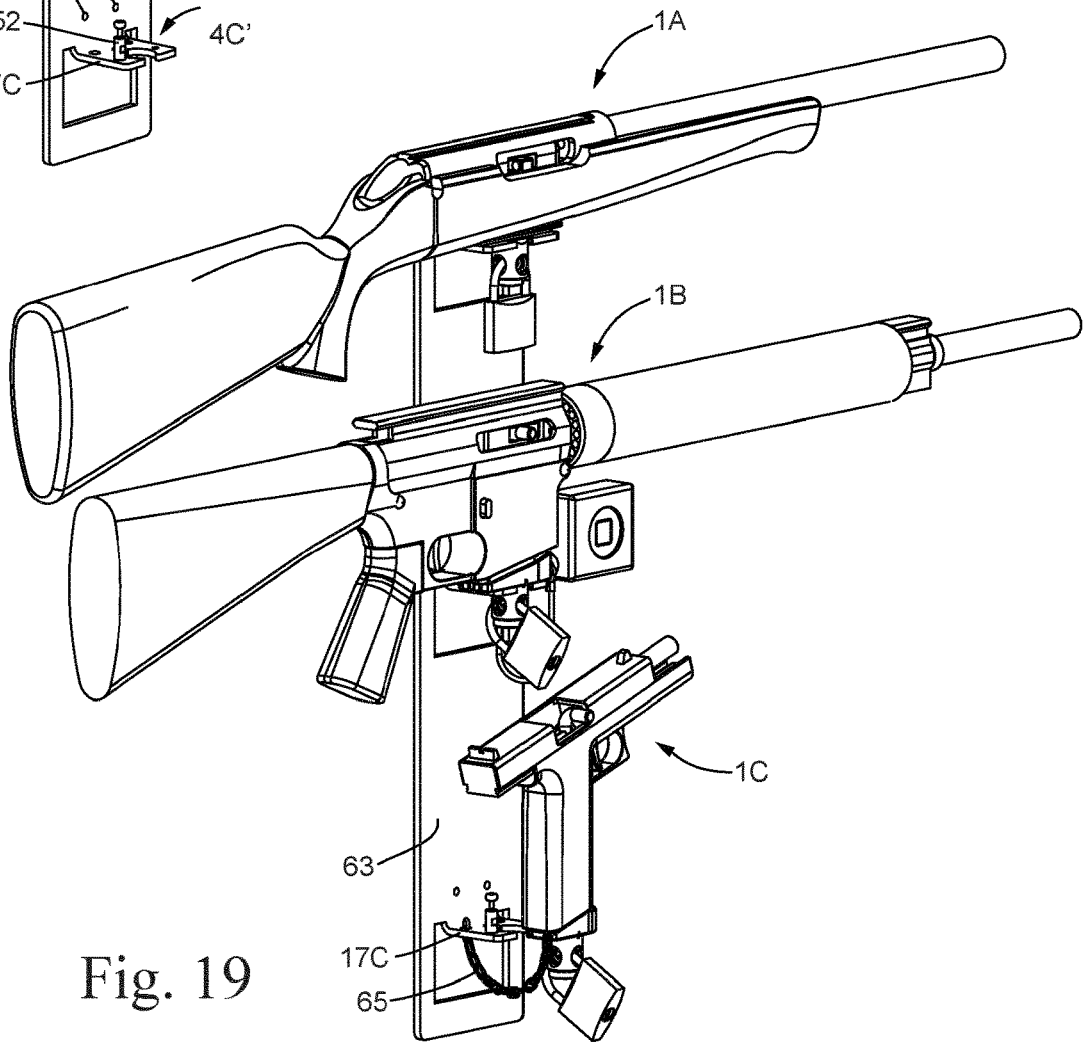

FIGS. 18 and 19 illustrate the use of the solution according to the invention in the storage and use of firearms. The rack elements 4B' and 4C' are implemented here as integral parts in a rack 63 made of a suitable plate for three type of firearms, the rack being provided with holes 64 through which it can be fastened with screws or the like to a wall, mounting plate or other suitable structure. The carrier part 17B of the uppermost element 4B' has projections 19B cut and bent into upright position from the element plate and provided with holes, while the carrier parts 17C of the lower elements 4C' have pins 52.

In FIG. 19, rifle guns 1A and 1B and a pistol gun 1C are placed on the rack 63. The insert of the pistol is not locked to the carrier part 17C of the rack element, but is bound to it by a chain 65, which can be used for the same purpose as the wire described in the previous examples.

Figure 20:
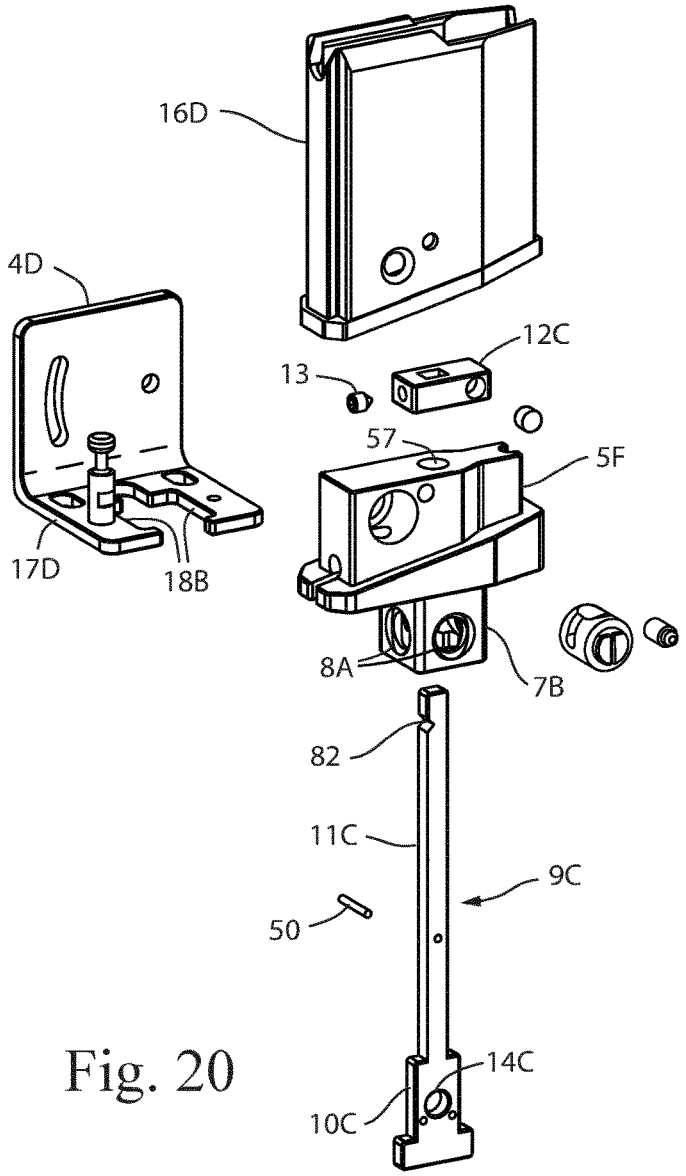
FIGS. 20 and 21 present a further embodiment of the safety device arrangement according to the invention in addition to the embodiments presented above.
Figure 21:
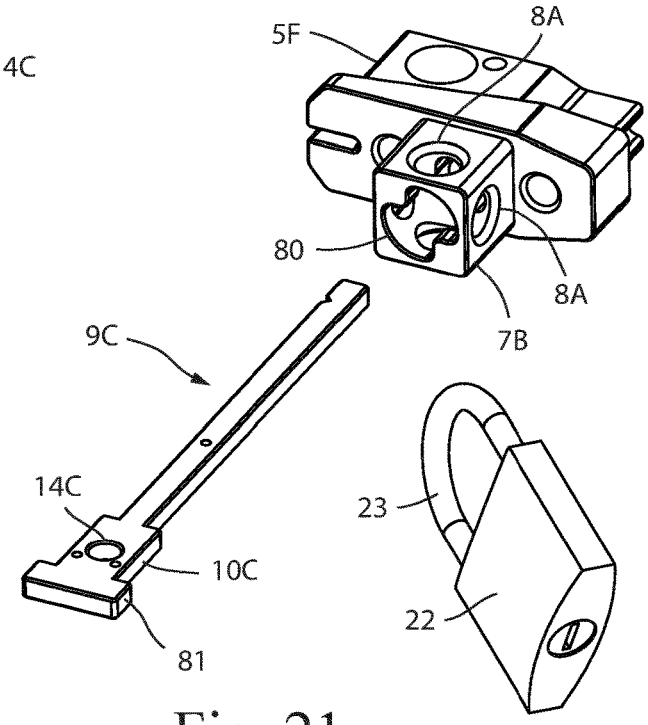

FIGS. 20 and 21 present an alternative to the solution according to the invention corresponding to that shown in FIG. 11, in which the implementations of the protrusion of the insert and, respectively, the rack element and the locking bar are clearly different. Only those different features will be considered here in further detail.

In this solution, the protrusion 7B of the insert locking body 5F has a square or rectangular cross-section with rounded corners, and the slot 18B of the rack element has a corresponding shape and dimensions. The slot is at the front edge of the carrier part 17D of the rack element open for part of its width. The holes 8A for locking in the walls of the protrusion 7B are equivalent to those previously described.

In this implementation, both the rack element and the locking bar 9C are suitable for being made of plate material. The base 10C of the locking bar is located inside the protrusion 7B and then functions as in the alternatives described previously. In contrast to cylindrical embodiments, the hollow space 80 of the protrusion is shaped so that the locking bar base 10C can be rotated there from the open position to the locking position and back, respectively, by about 90 degrees, and the base has a hole 14C for securing the locking by a lock.

The rod part 11C of the locking bar rises through the hole 57 through the locking body 5F, and is supported by a pin or the like 50 passing through the rod and being targeted at the upper surface of the body. A locking latch 12C provided with a hole corresponding to the dimensions and shape of the rod is fitted to its upper end and is held in place by a tightening screw 13 applied to the recess 82 of the rod.

FIGS. 22 to 24 present a further implementation of the locking between the insert and the rack element. A locking projection 83 shaped in a certain way is bent upwards from the carrier part 17G of the rack element 4G made of plate material. The locking body 5G of the insert has a space 86 for a corresponding locking plate 87, and the operation between them is best seen in FIG. 24, which is a section along line through the locking body 5G and the insert shell 16G indicated in FIG. 23.

At the end of the locking plate there is a spring 91 which fits into the recess 90, the protruding end of the spring coming against the wall of the space 86. When the insert is placed on the carrier part 17G, the bottom of the slot 88 of the locking plate comes against the oblique surface 85 of the projection 83, and the plate moves in space against the force of the spring 91 until it reaches the slot 84 of the projection. By the force of the spring, the plate 87 moves backwards, and the slots 84 and 88 of the projection and the plate engage in a locking state (FIG. 24).

This or a solution of this kind is one possible way of realizing the automatic locking of the insert to the rack element. The locking can then be opened by opening the locking between the firearm and the insert and by means of the lever 89 moving the locking plate against the force of the spring 91, so that the locking between the slots is released and the insert is released from the rack element.

The dashed part of FIG. 24 shows how the locking between the insert and the rack element can be permanently opened in this embodiment, so that the firearm locked with the insert can be taken freely from the rack and set back on it, for example in the demonstration. For this purpose, the locking slot 88 has an oblique edge surface 93 and its corner 94 is shaped so that when the plate 87 is pushed by the lever against the spring 91, it may be also rotated so that the corner 95 of the plate rotates slightly out of the space 86, as the side wall 96 of it is in the opening for the lever 89 left to extend so that the corner 95 can get locked against it.

The invention is not limited to embodiments such as those described above, but may vary within the scope of the accompanying claims.

The invention claimed is:

1. A safety device arrangement for a firearm with a magazine well comprising:

an insert that is adapted to the dimensions and shape of the magazine well and is lockable therein; and a rack element for carrying the firearm, wherein a body of the insert exposed from the magazine well is adapted in dimensions and shape to fit against a carrier part of the rack element, wherein the carrier part of the rack element is provided with an opening, slot, or equivalent, and the body of the insert exposed from the magazine well is provided with a hollow protrusion adapted to fit to said opening, slot, or equivalent and extend through and outside of the carrier part, and on the other hand opening inside the body, wherein in a locking mechanism between the insert and the magazine well an essential bar or equivalent is implemented to depart from and be lockable in said protrusion, accessories of the locking mechanism extending inside the insert, wherein a base part of said bar or equivalent is fitted to pivot in the protrusion and rotate the bar with the accessories between a first position locking the insert to the magazine well, and a second position releasing the locking, the protrusion and the base part comprising an arrangement for securing the first locking position with a lock, and wherein the protrusion is cylindrical in shape and the base part of the bar or equivalent is adapted in dimensions and shape to fit therein, walls of the protrusion and said base part comprising corresponding holes for securing said first locking position with a padlock or equivalent via the holes.

2. The safety device arrangement for a firearm according to claim 1, further comprising a separate arrangement for fastening the insert to the rack element so that the firearm locked to the insert protects the fastening.

3. The safety device arrangement for a firearm according to claim 2, wherein said separate arrangement comprises projections with holes extending from the carrier part of the rack element inside the body of the insert and pins or the like fastening said projections with holes to the corresponding holes of the body of the insert.

4. The safety device arrangement for a firearm according to claim 2, wherein said separate arrangement comprises pegs extending from the carrier part of the rack element inside the body of the insert, and pivot bushings operating in the body of the insert holes are targeted to said pegs and are fitted for locking to the pegs.

5. The safety device arrangement for a firearm according to claim 2, wherein said separate arrangement comprises a projection extending from the carrier part of the rack element inside the body of the insert and being provided with another slot or equivalent, and inside the body a locking plate is movable in a space and fitted for locking to said another slot of the projection.

6. The safety device arrangement for a firearm according to claim 2, wherein said separate arrangement further comprises an arrangement for performing the locking automatically when the insert is set as such or locked in place to the firearm on the rack element.

7. A safety device for a firearm with a magazine well, comprising:

an insert dimensioned and shaped for the magazine well, the insert being lockable therein; and a rack for carrying the firearm, wherein a body of the insert exposed from the magazine well is dimensioned and shaped to fit against a carrier part of the rack, wherein the carrier part includes an opening, and the body of the insert is provided with a hollow protrusion configured to fit to the opening and extend through and outside of the carrier part, and opening inside the body, wherein in a locking mechanism between the insert and the magazine well, a bar is implemented to be removable from and lockable in the protrusion, accessories of the locking mechanism extending inside the insert, wherein a base of the bar is fitted to pivot in the protrusion and rotate the bar with the accessories between a first position locking the insert to the magazine well, and a second position releasing the locking, and wherein the protrusion is cylindrical in shape and the base is dimensioned and shaped to fit therein, walls of the protrusion and the base comprising corresponding holes for securing the first locking position with a lock via the holes.

8. The safety device according to claim 7, further comprising an arrangement for fastening the insert to the rack so that the firearm locked to the insert protects the fastening.

9. The safety device for a firearm according to claim 8, wherein the arrangement comprises projections with holes extending from the carrier part of the rack inside the body of the insert and pins fastening said projections with holes to the corresponding holes of the body of the insert.

10. The safety device arrangement for a firearm according to claim 8, wherein the arrangement comprises pegs extending from the carrier part of the rack inside the body of the insert, and pivot bushings operating in the body of the insert holes are targeted to said pegs and are fitted for locking to the pegs.

11. The safety device arrangement for a firearm according to claim 8, wherein the arrangement comprises a projection extending from the carrier part of the rack inside the body of the insert and being provided with a slot, and inside the body a locking plate is movable in a space and fitted for locking to the slot of the projection.

12. The safety device arrangement for a firearm according to claim 8, wherein the arrangement further comprises an automatic lock.

13. A kit, comprising:

a firearm with a magazine well; and a safety device, comprising:

an insert dimensioned and shaped for the magazine well, the insert being lockable therein; and a rack for carrying the firearm, wherein a body of the insert exposed from the magazine well is dimensioned and shaped to fit against a carrier part of the rack, wherein the carrier part includes an opening, and the body of the insert is provided with a hollow protrusion configured to fit to the opening and extend through and outside of the carrier part, and opening inside the body, wherein in a locking mechanism between the insert and the magazine well, a bar is implemented to be removable from and lockable in the protrusion, accessories of the locking mechanism extending inside the insert, wherein a base of the bar is fitted to pivot in the protrusion and rotate the bar with the accessories between a first position locking the insert to the magazine well, and a second position releasing the locking, and wherein the protrusion is cylindrical in shape and the base is dimensioned and shaped to fit therein, walls of the protrusion and the base comprising corresponding holes for securing the first locking position with a lock via the holes.

14. The kit according to claim 13, wherein the safety device further comprises an arrangement for fastening the insert to the rack so that the firearm locked to the insert protects the fastening.

15. The kit according to claim 14, wherein the arrangement comprises projections with holes extending from the carrier part of the rack inside the body of the insert and pins fastening said projections with holes to the corresponding holes of the body of the insert.

16. The kit according to claim 14, wherein the arrangement comprises pegs extending from the carrier part of the rack inside the body of the insert, and pivot bushings operating in the body of the insert holes are targeted to said pegs and are fitted for locking to the pegs.

17. The kit according to claim 14, wherein the arrangement comprises a projection extending from the carrier part of the rack inside the body of the insert and being provided with a slot, and inside the body a locking plate is movable in a space and fitted for locking to the slot of the projection.

18. The kit according to claim 14, wherein the arrangement further comprises an automatic lock.

* * * * *